US007178949B2

(12) United States Patent
Bernard et al.

(10) Patent No.: US 7,178,949 B2
(45) Date of Patent: Feb. 20, 2007

(54) LIGHTING EQUIPMENT

(75) Inventors: Stefano Bernard, Orbassano (IT); Piermario Repetto, Orbassano (IT); Pietro Perlo, Orbassano (IT); Davide Capello, Orbassano (IT); Denis Bollea, Orbassano (IT)

(73) Assignee: C.R.F. Societa Consortile per Azioni (IT)

( * ) Notice: Subject to any disclaimer, the term of this patent is extended or adjusted under 35 U.S.C. 154(b) by 39 days.

(21) Appl. No.: 10/963,836

(22) Filed: Oct. 14, 2004

(65) Prior Publication Data

US 2005/0078483 A1 Apr. 14, 2005

(30) Foreign Application Priority Data

Oct. 14, 2003 (IT) ..... TO2003A0801

(51) Int. Cl.
*F21V 7/09* (2006.01)

(52) U.S. Cl. ..... 362/300; 362/307; 362/309; 362/337; 362/346; 362/311

(58) Field of Classification Search ..... 362/297, 362/223, 299, 300, 301, 307, 309, 337, 346, 362/341, 342, 350, 311; 359/853
See application file for complete search history.

(56) References Cited

U.S. PATENT DOCUMENTS

| | | | | |
|---|---|---|---|---|
| 1,697,450 | A * | 1/1929 | Anderson | 362/266 |
| 2,418,195 | A | 4/1947 | Rolph | |
| 3,805,052 | A | 4/1974 | Rambauske | |
| 4,367,519 | A * | 1/1983 | Houghton et al. | 362/477 |
| 4,866,329 | A | 9/1989 | Ferenc | |
| 4,882,662 | A * | 11/1989 | Prodell | 362/290 |
| 4,962,450 | A * | 10/1990 | Reshetin | 362/268 |
| 5,036,445 | A | 7/1991 | Osteen | |
| 6,659,631 | B2 * | 12/2003 | Butera et al. | 362/513 |
| 2001/0021112 | A1 * | 9/2001 | Taniuchi et al. | 362/518 |

FOREIGN PATENT DOCUMENTS

| | | |
|---|---|---|
| DE | 1 093 685 B | 11/1960 |
| DE | 101 31 997 A1 | 1/2003 |

(Continued)

*Primary Examiner*—Sandra O'Shea
*Assistant Examiner*—Sharon Payne
(74) *Attorney, Agent, or Firm*—Cook, Alex, McFarron, Manzo, Cummings & Mehler, Ltd.

(57) ABSTRACT

The lighting device comprises a light source and an associated hollow reflector of transparent material having an internal surface and an external surface which are close to and far away from the source respectively. The inner surface of the reflector has in cross section at least one transverse plane passing through the source a discontinuous profile forming a plurality of adjacent steps each of which has a first face through which rays originating from the source can pass and a second face essentially parallel to the rays originating from the source. The outer surface of the reflector has a profile comprising one or more arcs of curves. The reflector is constructed and positioned in such a way that in the said transverse plane most of the rays emitted by the source are reflected through the first face of the steps on its inner surface and strike its outer surface undergoing total internal reflection and after passing back through the reflector emerge from it through the second faces of the steps on its inner surface undergoing a second refraction.

22 Claims, 18 Drawing Sheets

FOREIGN PATENT DOCUMENTS

| | | |
|---|---|---|
| EP | 0 380 663 A1 | 8/1990 |
| FR | 2 390 673 A | 12/1978 |
| FR | 2 475 691 A | 8/1981 |
| GB | 531 185 A | 12/1940 |
| JP | 08 273 413 | 10/1996 |

* cited by examiner 0
8
E1
7
6a
6b
5a
1
6b
5
6
F1
6b
A
2
6a
E1
4
3
F2
6
5b
E1
6a
0
9
6
6b

LIGHTING EQUIPMENT

BACKGROUND OF THE INVENTION

This invention relates to lighting devices and more specifically lighting devices of the type comprising a light source and an associated reflector.

SUMMARY OF THE INVENTION

One object of this invention is to provide innovative lighting device offering high efficiency which can be manufactured simply and economically, and whose reflectors do not require complete coating with light-reflecting materials, for example of the type with aluminum or silver.

Another object of this invention is to provide lighting equipment whose structure also provides the prospect of innovative solutions from the aesthetic point of view.

These and other objects are accomplished according to the invention through a lighting device comprising:

a light source, and;

an associated hollow reflector of transparent material having an inner surface and an outer surface close to and far from the source respectively;

the inner surface of the reflector having in cross-section in at least one transverse plane passing through the source a discontinuous profile forming a plurality of adjacent steps each of which have a first face through which rays originating from the source may pass and a second face substantially parallel to the rays originating from the source through which rays originating from the source and reflected from the outer surface of the reflector may pass;

the outer surface of the reflector having a curved profile in the said transverse plane, whose shape depends substantially on the divergence which it is desired to obtain in the light beam leaving the lighting device;

the reflector being constructed and arranged in such a way that in the said transverse plane the rays emitted by the source are refracted at its inner surface through the first faces of the said steps, strike its outer surface undergoing total internal reflection and passing back through the inner surface through the second faces of the said steps to re-emerge outside the reflector.

As previously stated, the shape of the outer surface of the reflector is in general calculated on the basis of the divergence and intensity distribution which it is desired to obtain in the light beam leaving the lighting device. In order to produce a very narrow light distribution, that is a substantially collimated beam, the shape of the outer surface of the said transverse plane will be substantially that of an arc of a parabola or several arcs of coaxial parabolas with the focus substantially coinciding with the source. For a wider intensity distribution the shape of the outer surface will be substantially that of:

1) an arc of a parabola with the focus suitably displaced from the source;
2) several arcs of non-coaxial parabolas and/or with the focus suitably offset from the source;
3) one or more arcs of ellipses or hyperbolas, the choice between the two conic sections depending upon the dimensional constraints of the lighting device.

An arrangement which provides for the use of arcs of different conic sections in the same profile may also be envisaged.

The envelopes of the steps provided on the inner surface of the reflector, defined as the curve passing through the apices of the said steps in the said transverse cross-section of the reflector, is obtained through the provision of steps on the outer surface of the reflector; this arrangement makes it possible to maximize the uniformity of the reflector thickness, reducing to a minimum so-called piping and other deformations caused by shrinkage of the material and resulting from injection molding being reduced.

In one embodiment the outer surface of the reflector in the said transverse plane passing through the source has a profile comprising a plurality of arcs of ellipses, which are preferably contiguous, with different eccentricities, each of which has a respective first focus substantially coinciding with the geometric center of the source in that plane.

In another embodiment the outer surface of the reflector in the said transverse plane passing through the source has a profile comprising a plurality of arcs of hyperbolas, preferably contiguous, having different eccentricities, each of which has a corresponding first focus substantially coinciding with the geometric center of the source in that plane.

In another embodiment the outer surface of the reflector in the said transverse plane passing through the source has a profile comprising a plurality of arcs of hyperbolas and ellipses, preferably alternating with each other, having different eccentricities, each of which has a corresponding first focus substantially coinciding with the geometric center of the source in that plane.

In another embodiment the outer surface of the reflector in the said transverse plane passing through the source has a profile comprising a plurality of arcs of parabolas, each of which has a focus substantially offset from the geometrical center of the source in that plane and/or an axis which is inclined with respect to the axis of the lighting device.

In the first embodiment, the reflector may have a shape essentially in the form of a portion of a rotation paraboloid, ellipsoid, or hyperboloid. An alternative and complementary embodiment provides a reflector comprising preferably contiguous portions of rotation paraboloids and/or ellipsoids and/or hyperboloids.

According to a further embodiment, the reflector has a shape essentially in the form of one or more preferably contiguous portions of those toruses having a parabolic and/or elliptical and/or hyperbolic cross-section, and the source has an annular shape and is located substantially on the focal circumference common to those toruses having a parabolic and/or elliptical and/or hyperbolic cross-section. In this case, the source is conveniently a circular ring lamp, such as a fluorescent lamp, for example the FC55W model from Osram or the TL K 60W from Philips.

In a further embodiment the reflector may conveniently have a shape essentially in the form of one or more preferably contiguous portions of cylinders having a parabolic and/or elliptical and/or hyperbolic cross-section, and the source correspondingly has a linear shape and is essentially located on a common linear focus for the said cylinder having a parabolic and/or elliptical and/or hyperbolic cross-section. In such a reflector each extremity of the said portions of the cylinder having a parabolic and/or elliptical and/or hyperbolic cross-section may have a corresponding terminal portion essentially in the form of one or more portions of a rotation paraboloid and/or ellipsoid and/or hyperboloid.

BRIEF DESCRIPTION OF THE DRAWINGS

Further features and advantages of the invention will appear from the detailed description which follows, provided purely by way of a non-limiting example, with reference to the appended drawings in which.

DETAILED DESCRIPTION OF THE INVENTION

Figure 1:
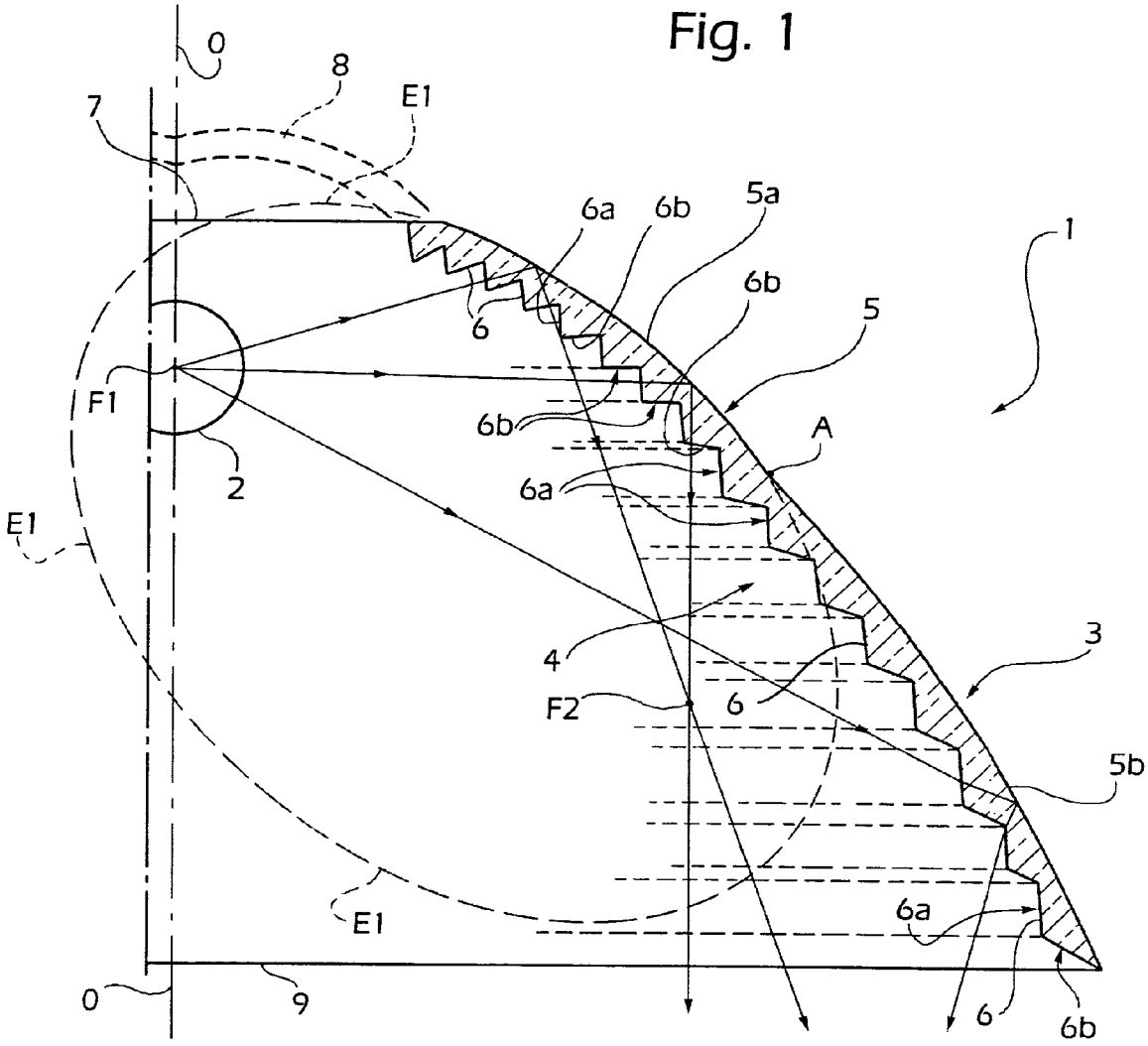
FIG. 1 is a partial view of a lighting device according to the invention, sectioned in a transverse plane passing through the source.

In FIG. 1, a lighting device according to this invention is indicated as a whole by 1.

This device 1 comprises a light source 2, for example an incandescent lamp, a fluorescent lamp or a halogen lamp.

A hollow reflector indicated as a whole by 3 is associated with light source 2.

Reflector 3 is manufactured from a transparent material, for example glass, polycarbonate or polymethylmethacrylate.

Reflector 3 has an inner surface 4 and an outer surface 5, close to and far from source 2 respectively.

The inner surface 4 of reflector 3 has a discontinuous profile in cross-section forming a plurality of adjacent steps 6, each of which has a first face 6*a* through which rays originating from source 2 may pass and a second face 6*b* essentially parallel to the rays originating from source 2 through which rays originating from the source and reflected from the outer surface 5 of reflector 3 may pass.

Steps 6 are preferably constructed in such a way that the thickness of reflector 3 lies between a maximum of 6 mm and a minimum of 3 mm; the consequent dimensions of steps 6 ensure that the reflector profile can easily be manufactured, and at the same time comprises a highly characteristic feature from the aesthetic point of view.

As an alternative steps 6 may be constructed in such a way that the thickness of reflector 3 lies between a maximum of 5 mm and a minimum of 4 mm; in this case the smaller dimensions of the steps renders them substantially poorly visible, although their reflecting properties remain unchanged. The advantage of this embodiment lies in the greater ease of molding.

Conveniently reflector 3 is manufactured by molding, for example injection molding, and the inclinations of faces 6*a* and 6*b* of the steps in its inner surface 4 is such as to permit easy removal of the reflector from the mold used to manufacturer it.

Conveniently faces 6*a* and 6*b* of steps 6 of inner surface 4 of the reflector are connected together on the basis of criteria which will be mentioned below.

Outer surface 5 of the reflector has a profile in the plane of the transverse cross-section shown in FIG. 1 whose shape generally depends on the shape and intensity distribution of the beam leaving the lighting device which it is desired to obtain; this shape may substantially comprise:

1) One or more arcs of coaxial parabolas having their focus substantially coinciding with the source;
2) One or more arcs of non-coaxial parabolas and/or with the focus suitably offset from the source;
3) One or more arcs of ellipses or hyperbolas, as selected according to the dimensional constraints of the lighting device.

In general the divergence of the beam depends not only on the shape of outer surface 5 of reflector 3 but also on the inclinations of the faces 6*a* and 6*b* of the steps on the inner surface 4 of reflector 3, and the size of source 2.

In a preferred embodiment, outer surface 5 of the reflector has a profile in the plane of the transverse section shown in FIG. 1 comprising an arc of a substantially elliptical curve and, in the specific example illustrated in FIG. 1, two arcs of ellipses indicated by 5*a* and 5*b* respectively which meet at a point indicated by A. These arcs of ellipses or portions of the profile of outer surface 5 of the reflector have a corresponding first focus F1 substantially coinciding with the geometrical center of source 2. The ellipse E1 to which arc 5*a* of the profile of the outer surface 5 of the reflector belongs is shown by a dashed line in FIG. 1. Ellipse E1 has a second focus at a point F2.

Arc 5*b* of an ellipse also belongs to an ellipse, not shown in FIG. 1, which has a focus coinciding with the geometrical center F1 of the lamp or source 2, and another focus (not illustrated) located outside and beneath reflector 3.

The location of the second focus is such as to ensure satisfaction of the geometrical conditions so that the rays striking outer surface 5 are reflected through total internal reflection, as specified below, and at the same time is such as to make it possible to control the divergence of the beam; a focus close to the reflector gives rise to marked divergence, a focus offset by some amount from the optical axis O—O causes the rays to tend to be reflected through very large angles.

Figure 9:
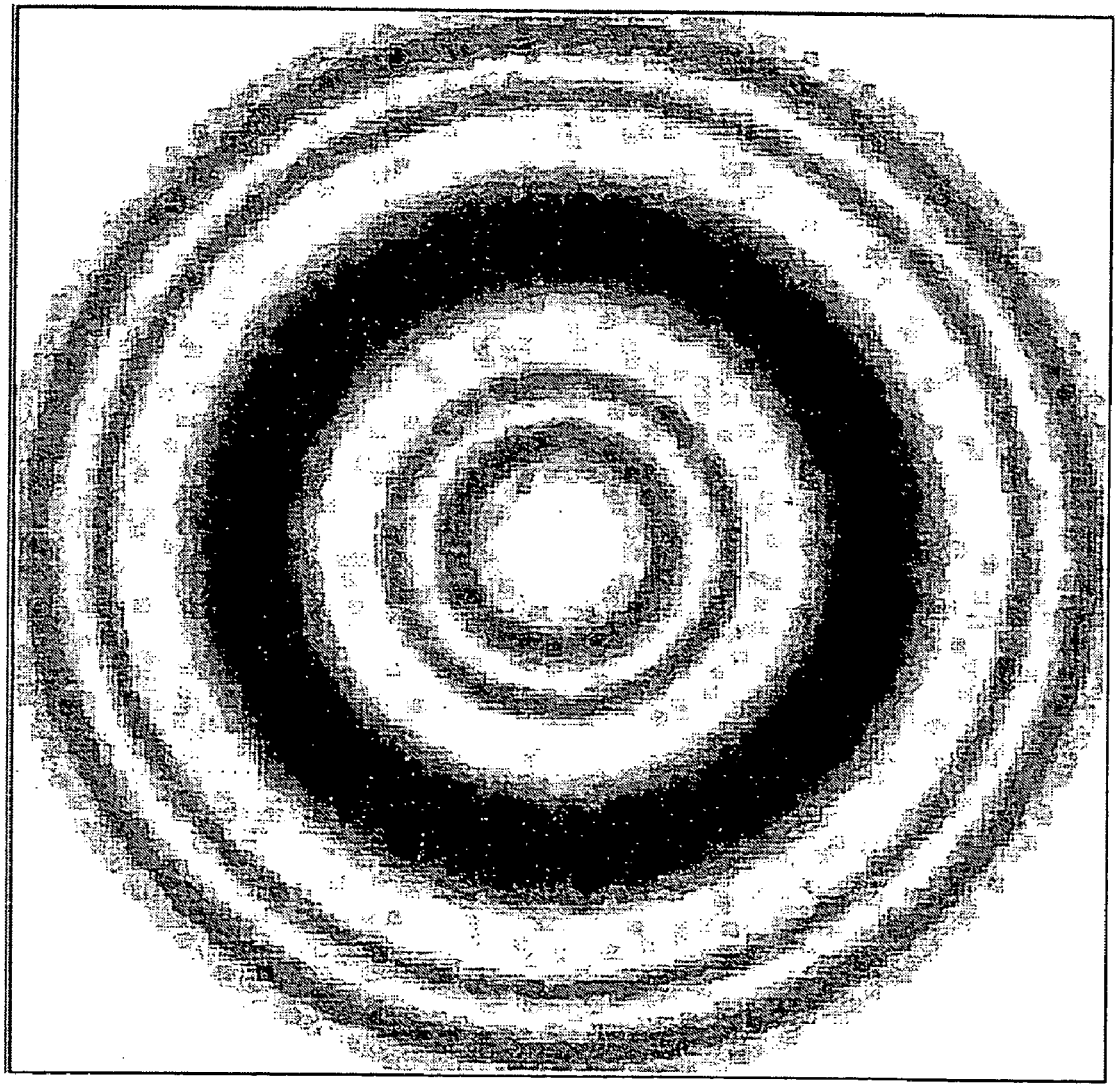
FIG. 9 is the local luminance profile of a lighting device according to FIGS. 3 to 5, as perceived by an observer located beneath it.

In a preferred embodiment connection point A between the arcs of ellipses lie in a profile which is substantially but not necessarily parabolic. The advantage of this proposed embodiment lies in the fact that when an observer looks at the lighting device at an angle (with respect to the optical axis O—O) which is smaller than the maximum angle of divergence of the light reflected by the device, his eye receives light originating from all the various elliptical sectors, which results in lower local luminance values and a more uniform luminance distribution for the exit surface of the reflector. The visual sensation produced, shown in FIG. 9, is that of seeing multiple replicates of the source, each generated by the portion of the reflector associated with an arc of an ellipse; this effect cannot otherwise be achieved using an outer reflector surface with a substantially continuous curvature, for example a single parabola, ellipse or hyperbola. A similar effect can be achieved using several arcs of hyperbolas; in this case the second focus for each of the said arcs of hyperbolas is virtual.

Reflector 3 is constructed and arranged in such a way that the rays issuing from light source 2 are incident upon faces 6*a* of its inner surface 4 and are reflected through it so as to strike its outer surface 5. At surface 5 the rays undergo total internal reflection and re-emerge outside the reflector through faces 6*b* of its inner surface 4, in a direction to a first approximation towards the second focus of the ellipse to which the portion of profile 5*a* or 5*b* at which these rays have undergone total internal reflection belongs.

Under the conditions of total internal reflection substantial conservation of the energy of the light rays reflected in this way is ensured.

The surfaces of the faces 6*b* of the inner surface 4 of the reflector are conveniently constructed in such a way as to prevent the light emerging from source 2 striking it directly, instead of following the forms of propagation described above.

The second focus of the portion or each portion having an elliptical profile of the outer surface 5 of reflector 3 essentially corresponds to the region from which the reflected rays appear to virtually diverge for the user.

Figure 2:
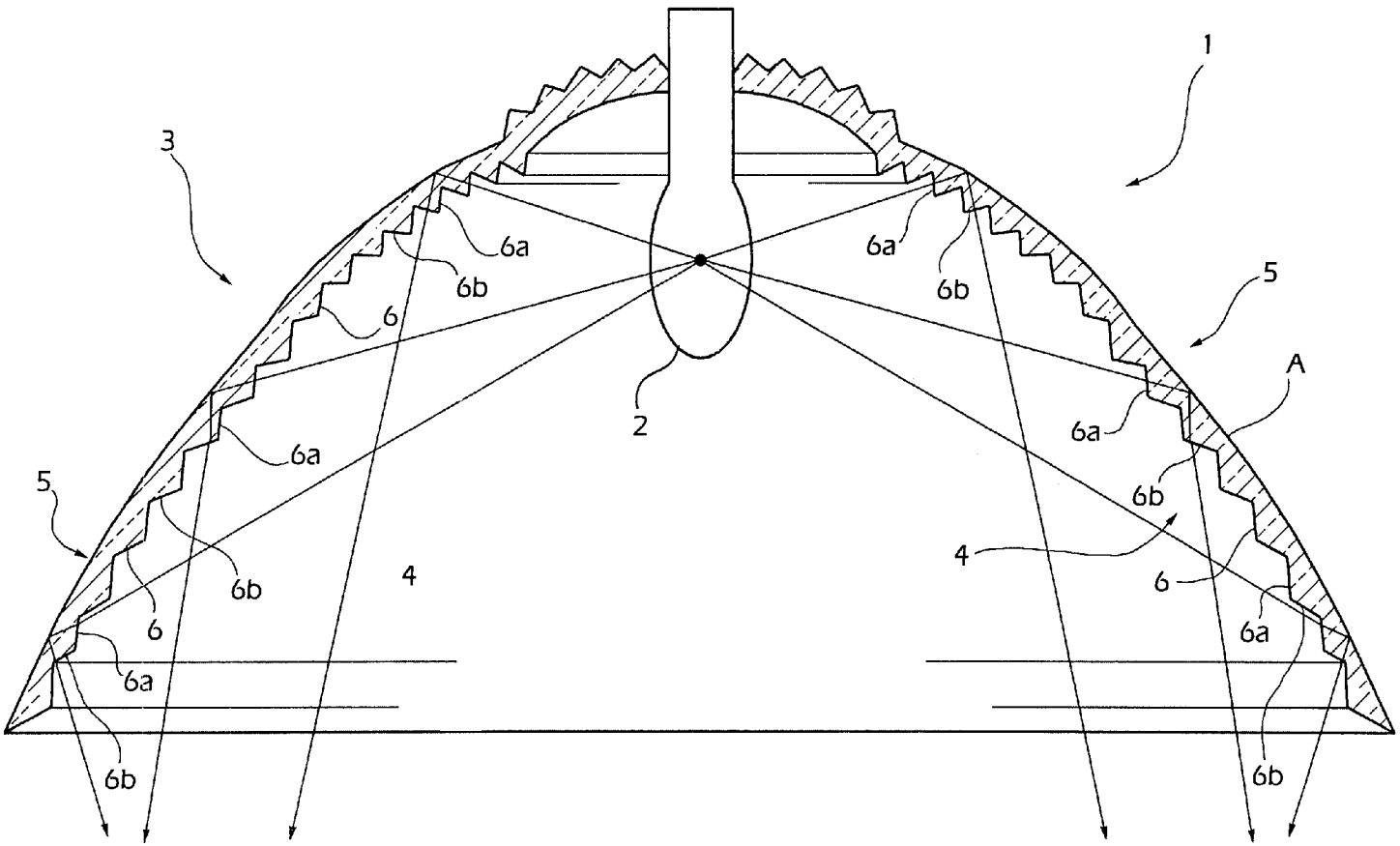
FIG. 2 is a cross-sectional view of a lighting device according to a preferred embodiment of the invention.

In a first embodiment, shown by way of example in FIG. 2, reflector 3 may have a shape essentially in the form of a portion of a rotation ellipsoid, obtained for example by causing the cross-section of the reflector illustrated in FIG. 1 to rotate about the axis O—O. In this case light source 2 is a concentrated source, such as an incandescent lamp, a halogen lamp or a compact fluorescent lamp.

Figure 3:
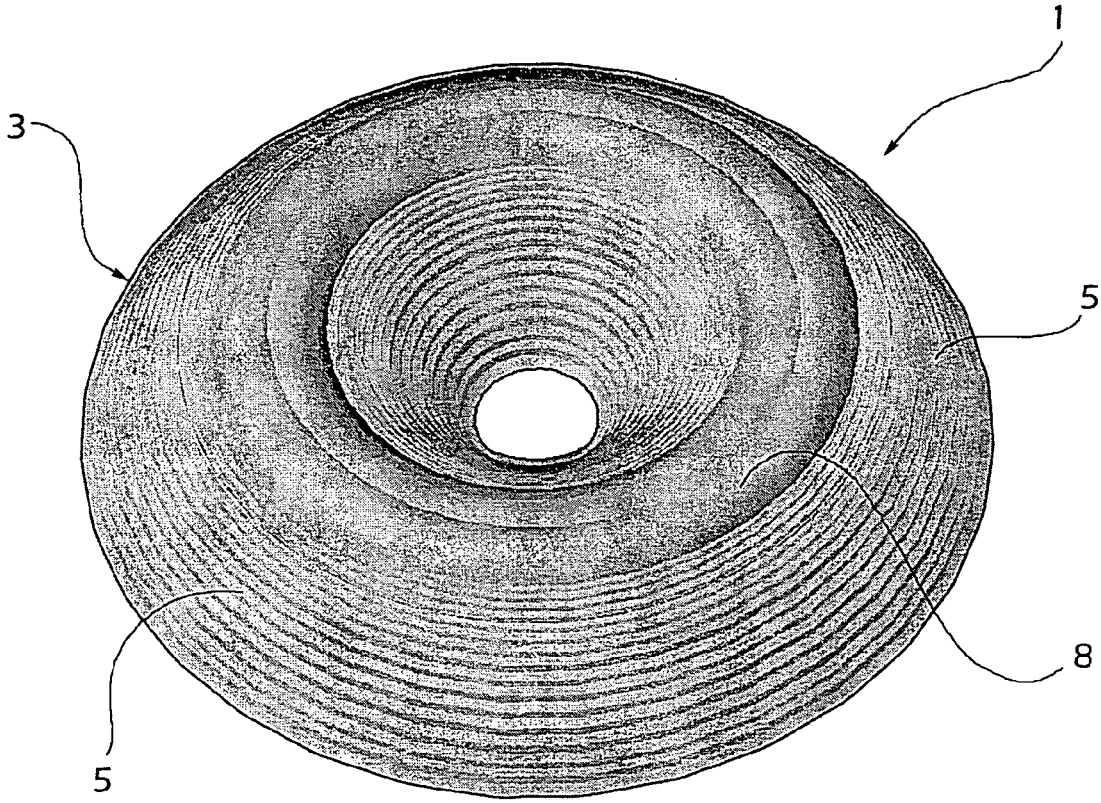
FIG. 3 is a perspective view of a lighting device according to the invention.
Figure 4:
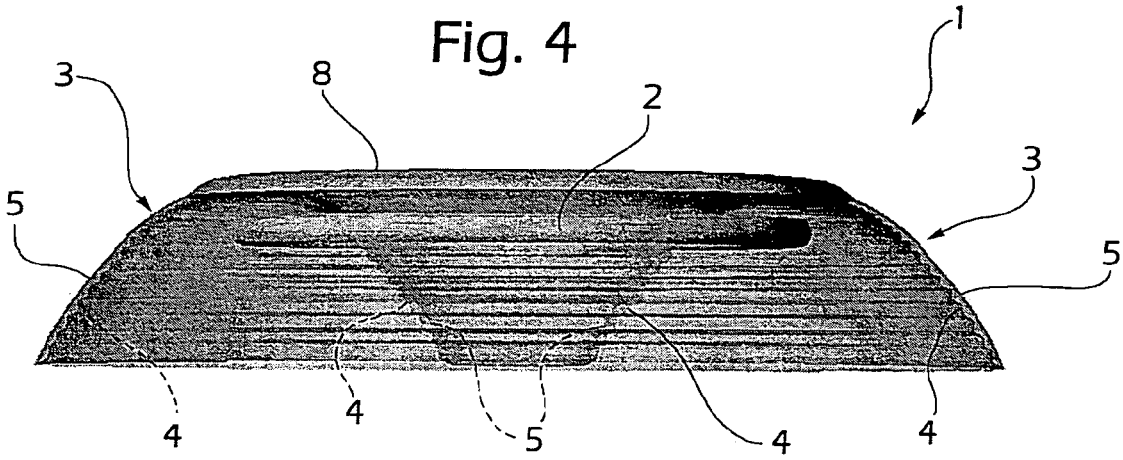
FIG. 4 is a view in lateral elevation of the lighting device illustrated in FIG. 3.
Figure 5:
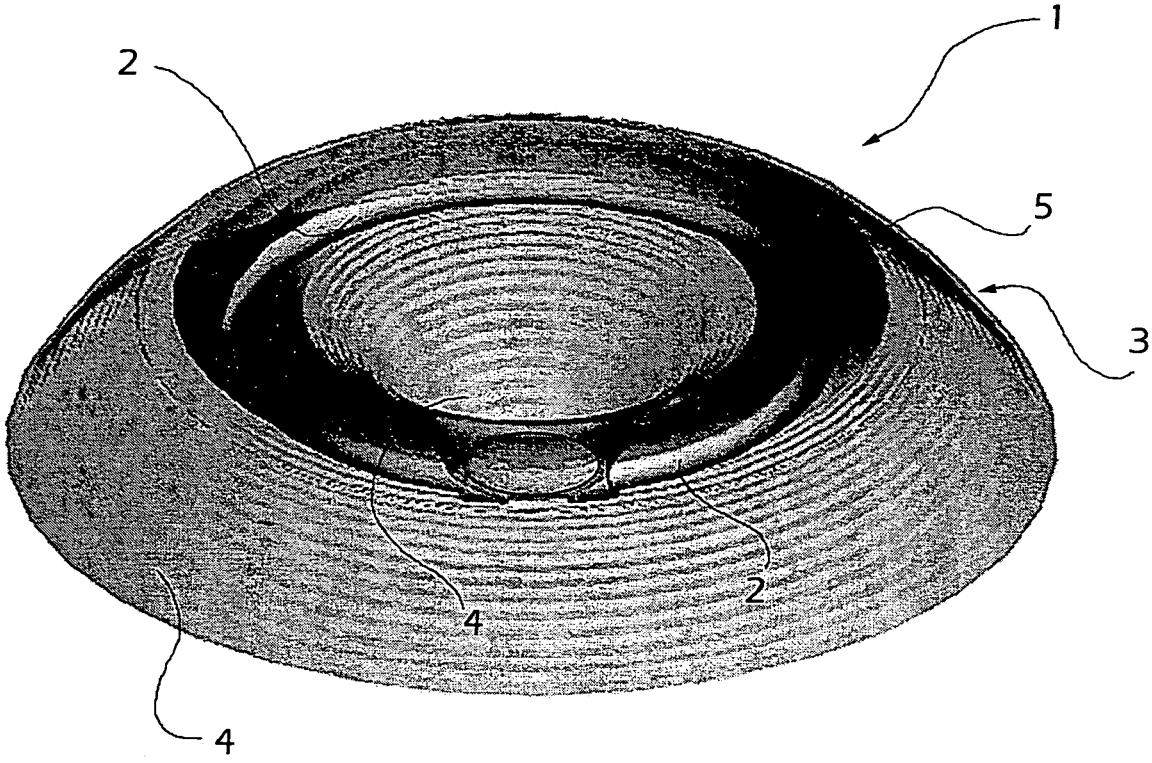
FIG. 5 is a perspective view from the base of the lighting device according to FIGS. 3 and 4.

In a variant embodiment illustrated in FIGS. 3 to 5, reflector 3 has a shape essentially in the form of a portion of a torus having a substantially elliptical cross-section essentially cut in a plane parallel to the equatorial plane, obtained for example by causing the (complete) cross-section of the reflector illustrated in FIG. 1 to rotate about an axis parallel to the O—O axis. Light source 2 (FIGS. 4 and 5) then has an annular shape and is essentially located along the focal circumference of the said torus having an elliptical cross-section.

Again in the embodiment according to FIGS. 3 to 5, the profile in transverse cross-section of outer surface 5 of reflector 3 may comprise a succession of arcs of substantially elliptical curves having a common focus, along the focal circumference of which light source 2 extends.

Figure 11:
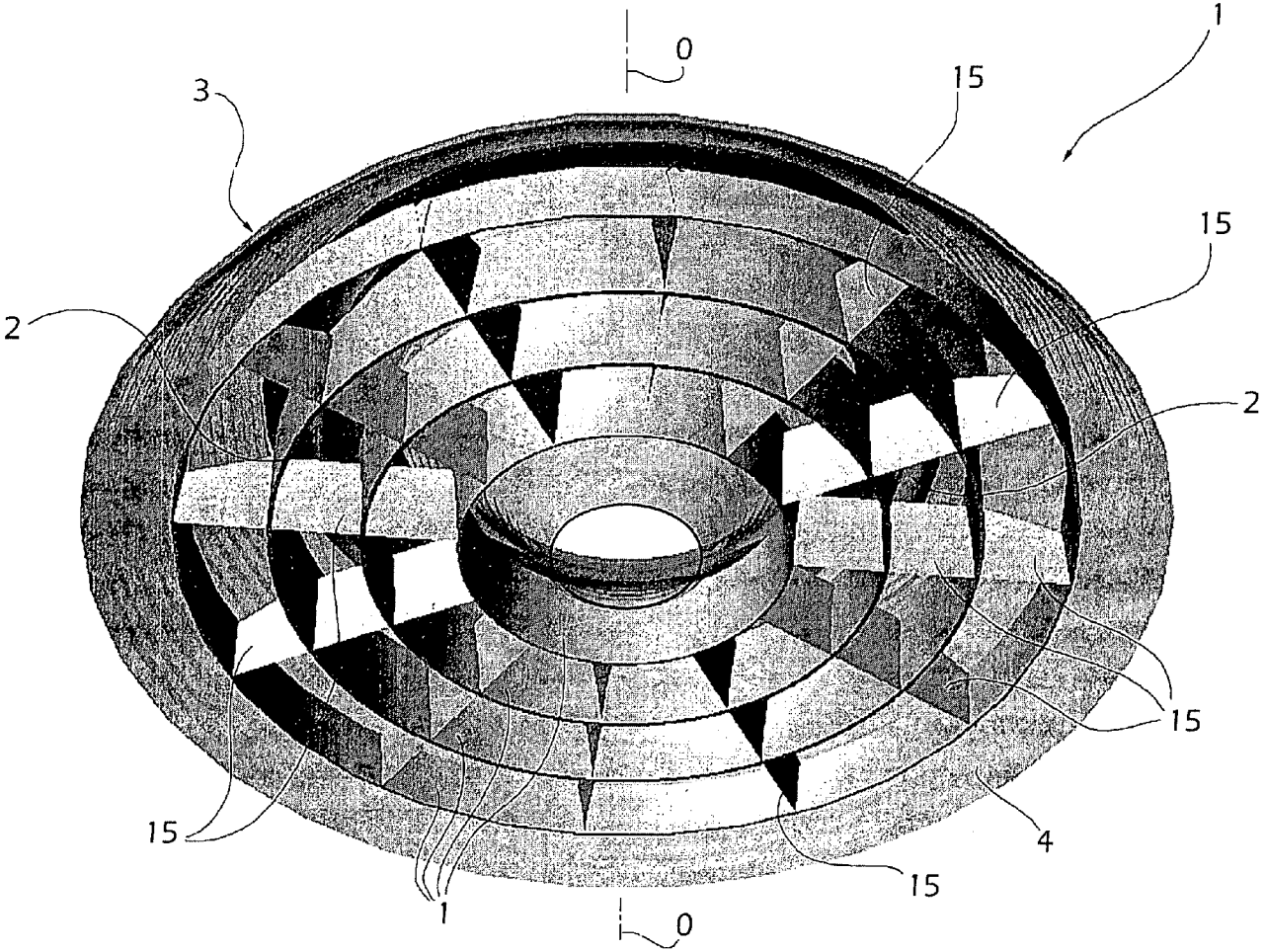
FIG. 11 is a perspective view similar to that illustrated in FIG. 4, and shows a lighting device provided with a brightness control structure in the opening of its reflector.

FIG. 11 also shows an embodiment of a lighting device according to the invention in which reflector 3 has a shape essentially in the form of a portion of a torus having a substantially elliptical cross-section and light source 2 has an annular shape.

The embodiments of the reflector in FIGS. 3 to 5 and in FIG. 11 can guarantee an efficiency of approximately 84%, understood as the ratio between the flux measured on the ground and the flux emitted by the source.

Figure 13:
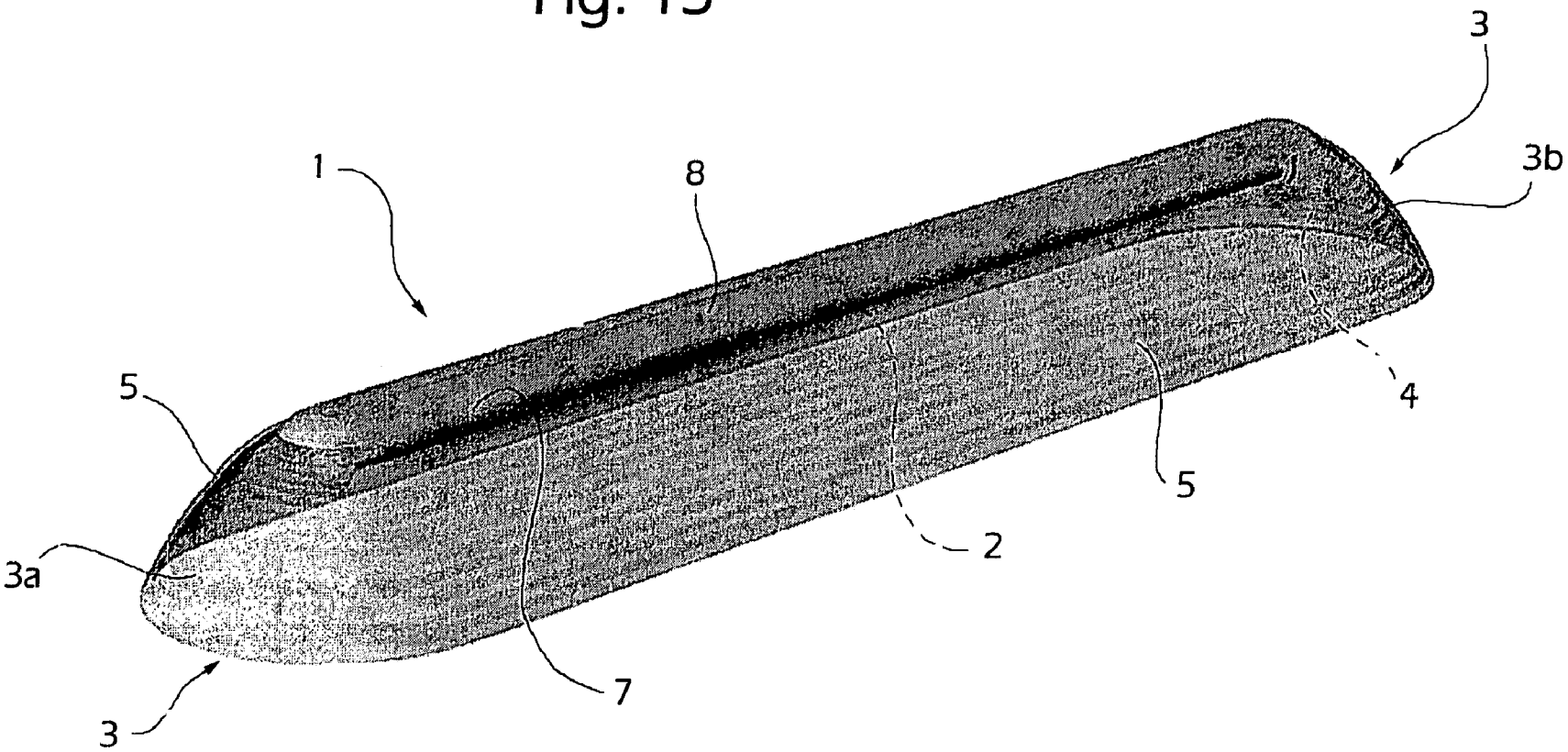
FIG. 13 and FIG. 14 are perspective views from the top and bottom respectively of a further embodiment of a lighting device according to the invention comprising a light source of a linear type.
Figure 14:
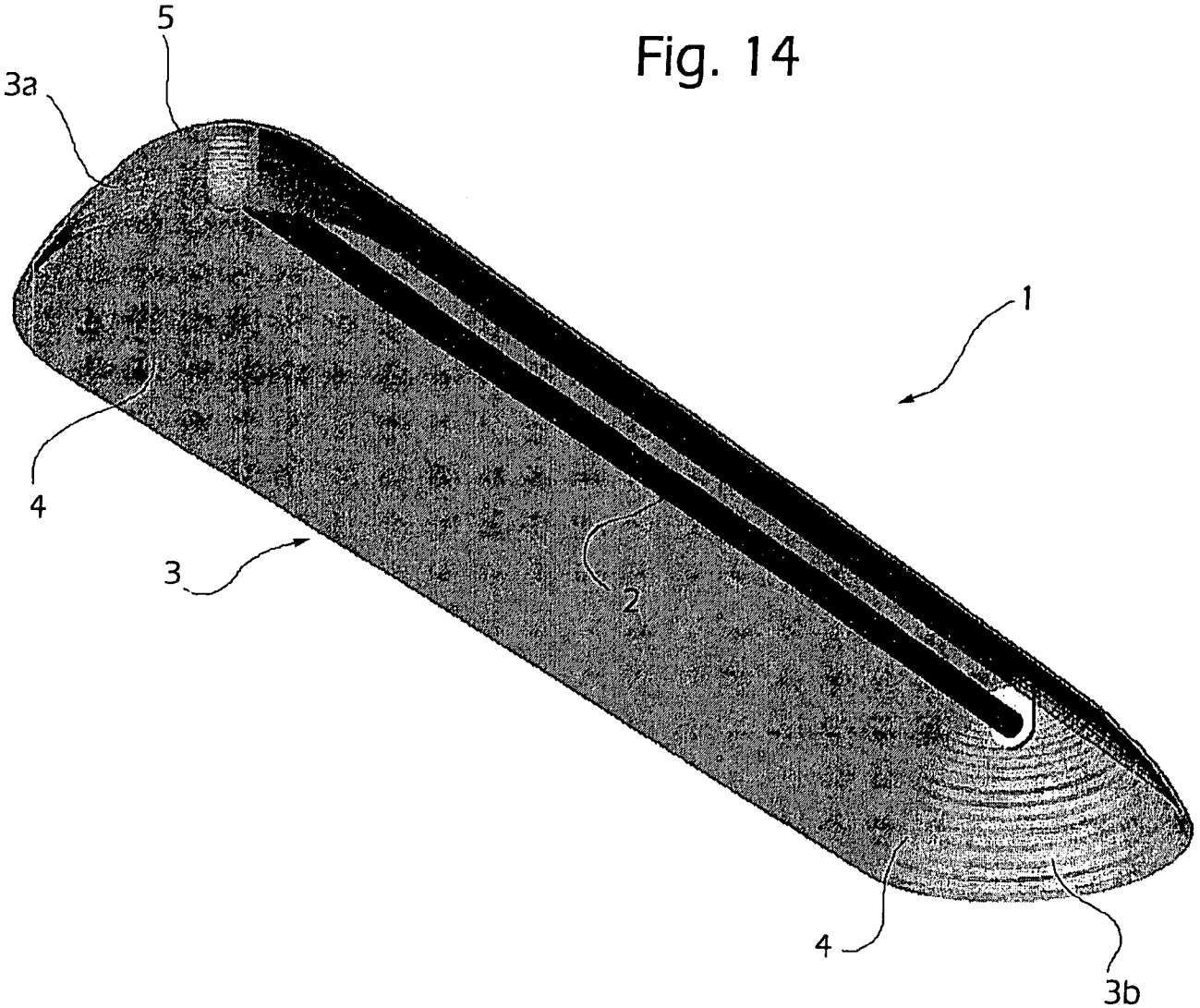

In FIGS. 13 and 14 reflector 3 has a shape essentially in the form of a portion of a cylinder having a substantially elliptical cross-section, obtained by mathematically "extruding" the (complete) cross-section of the reflector illustrated in FIG. 1 along an axis normal to the plane of the cross-section in FIG. 1, and light source 2 has a linear shape and lies essentially along a focal straight line for the said cylinder having an elliptical cross-section. In the embodiment illustrated in particular in FIGS. 13 and 14, at each extremity of the portion of a cylinder having an elliptical cross-section reflector 3 has a corresponding terminal portion 3*a*, 3*b* essentially in the form of a semi-annular portion of a rotation ellipsoid.

Now again making reference to FIG. 1, reflector 3 illustrated therein, on the side of the said focus F2 with respect to first focus F1, has an opening 7 which may be:

1) completely open;
2) closed with a transparent connecting surface;
3) closed with a connecting surface of which at least a part is diffusing.

In this way the light emitted upwards from the source may be used for example to illuminate the ceiling of a room.

As an alternative, this opening may be closed with an evolute profile 8, as illustrated diagrammatically by a dashed line in FIG. 1, coated on its outer surface with a reflecting material, for example aluminum or silver, so that the light which source 2 radiates upwards can also be recovered and redirected downwards.

Figure 15:
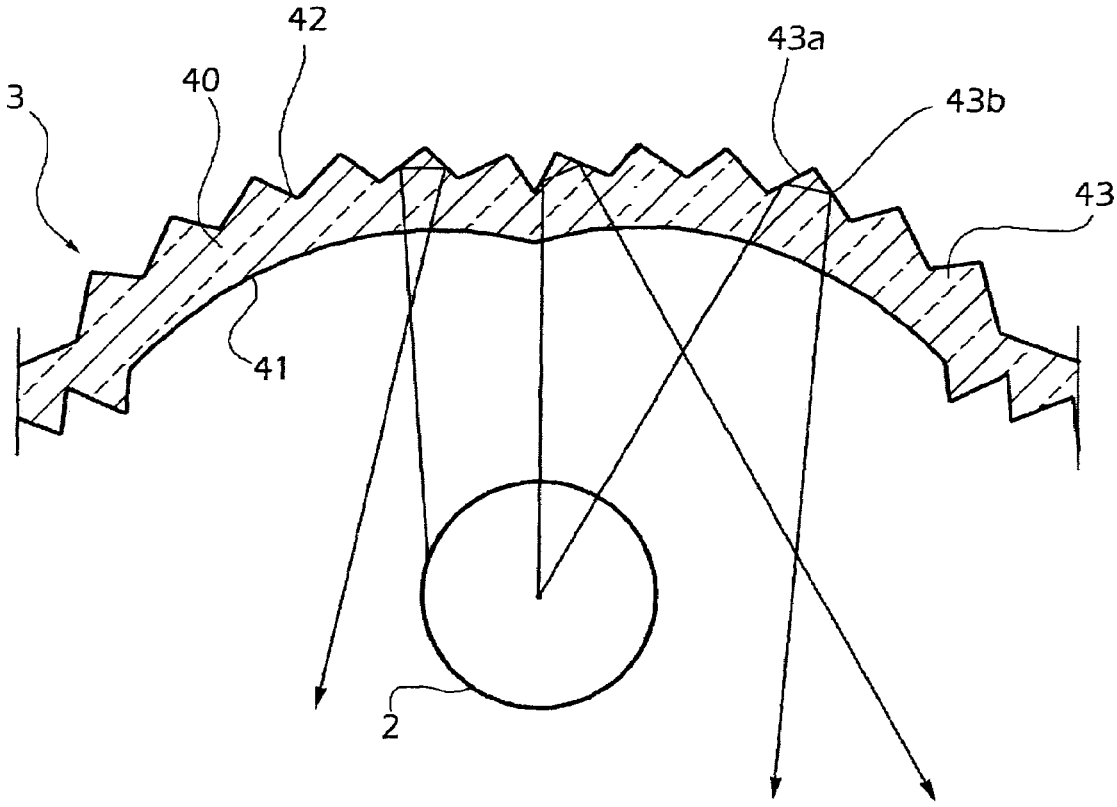
FIG. 15 is a view in partial cross-section of a reflector of a device according to the invention showing one possible form of a transparent posterior profile.

As an alternative, as illustrated purely by way of example in FIG. 15, the said opening may be closed by a connecting wall to an outer surface 42 having at least one transverse cross-section with a discontinuous profile, so that after passing through the inner surface 41 of reflector 3 the rays emitted towards the connecting wall by source 2 undergo double total internal reflection at the two faces 43*a* and 43*b* of each tooth 43 of the said discontinuous profile, being therefore substantially reflected inwards and re-emerging from the connecting surface through inner surface 41.

In the case of ceiling mounting, the above mentioned arrangements differ in the different percentage of light reflected downwards or the percentage of light directed towards the ceiling.

Considering a specific geometry of the device by way of example, in the case of an evolute with an outer reflecting surface (reflectance indicatively 0.8) an efficiency of 84% is achieved on the floor, whereas if the evolute does not have this coating the efficiency is approximately 55%; adopting the arrangement of an evolute with total internal reflection, an efficiency on the floor of 70% is achieved.

What has just been described in connection with the top part of reflector 3 according to FIG. 1 also applies, making the necessary changes, to reflectors 3 of the lighting devices according to the embodiments illustrated in FIGS. 3 to 5 and 13, 14.

Figure 6:
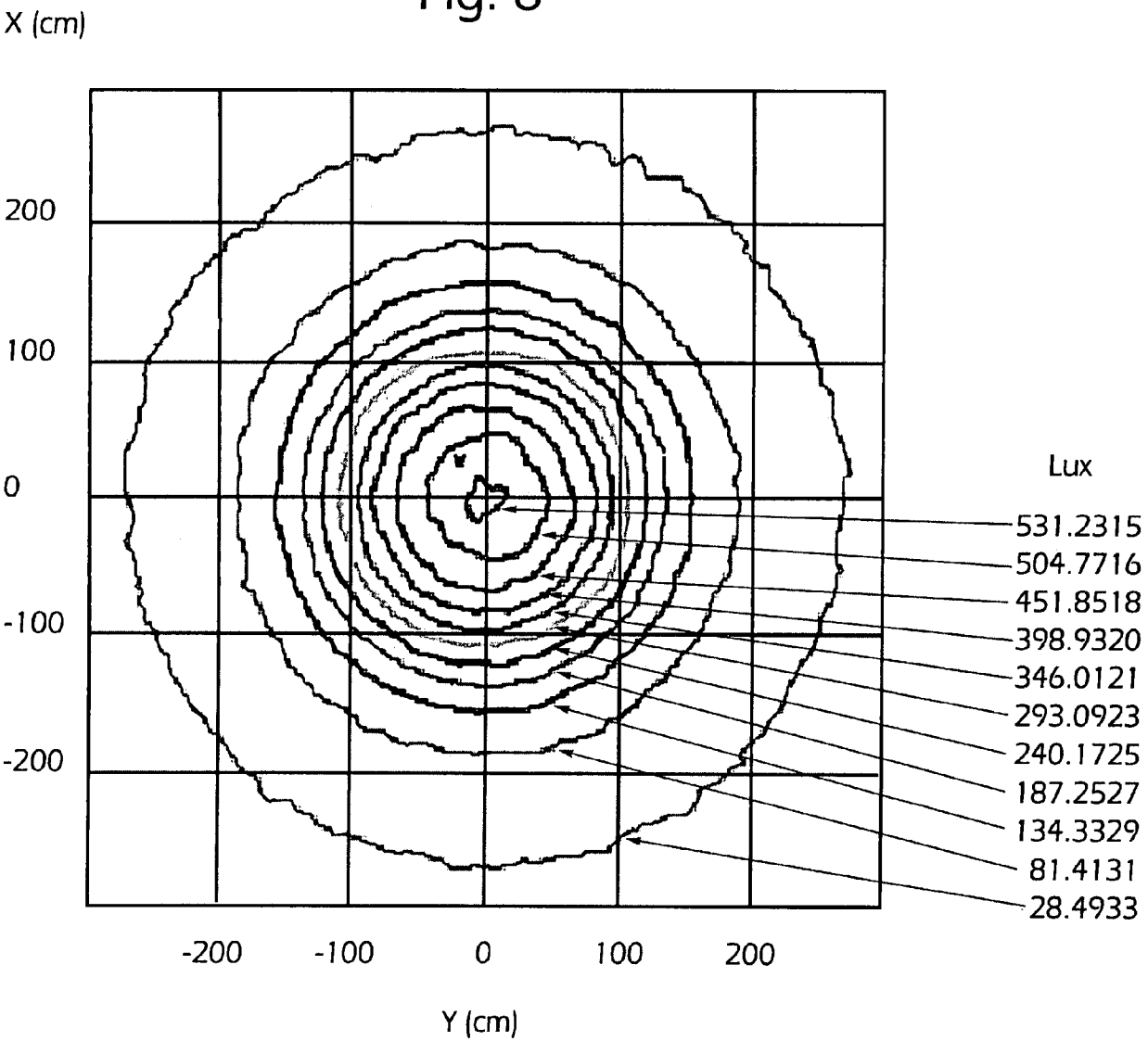
FIG. 6 is a diagram of the illumination on a plane located 1.60 m below the opening of a lighting device according to FIGS. 3 to 5.
Figure 7:
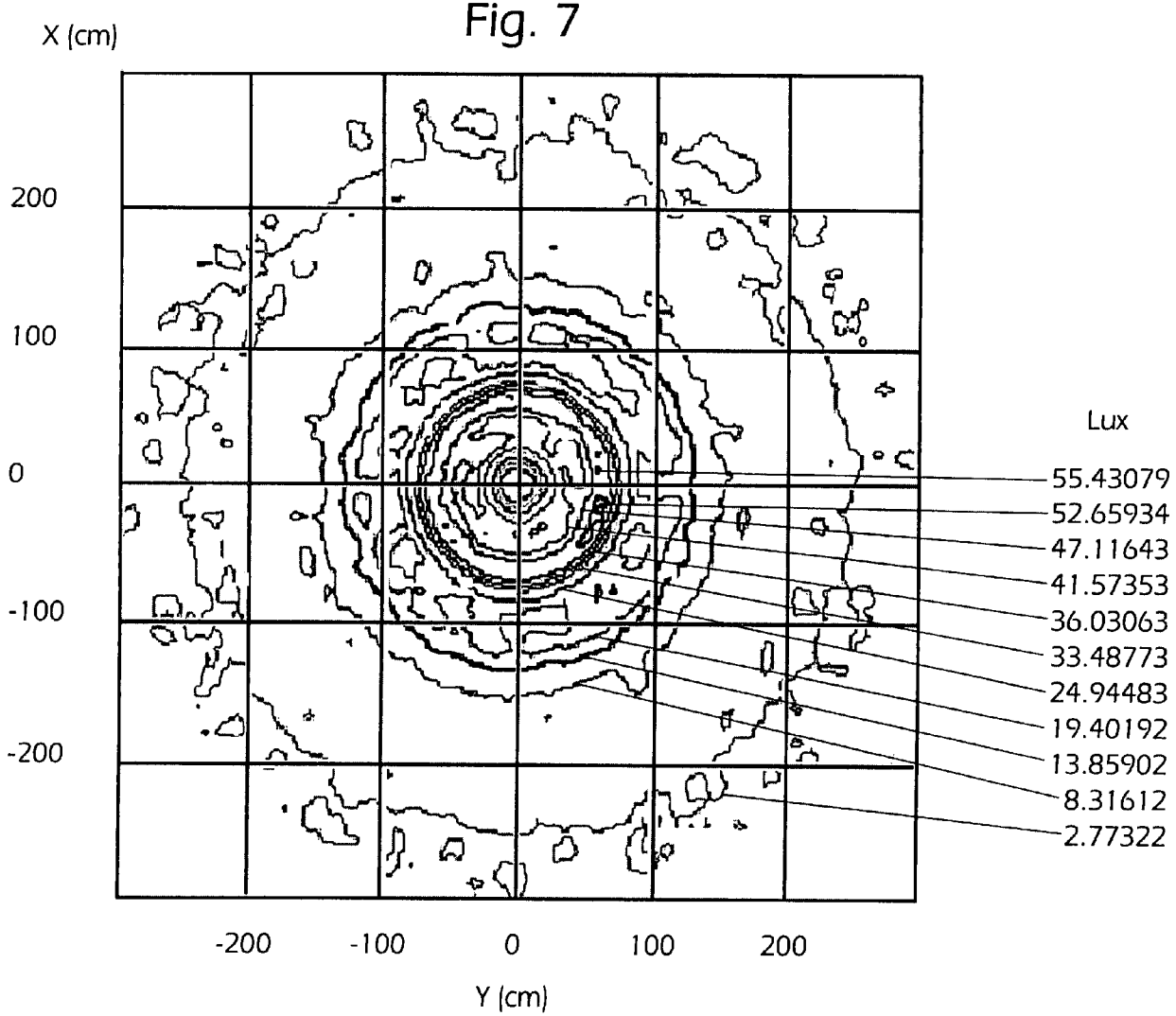
FIG. 7 is a diagram of the illumination on a plane lying 0.60 m above the reflecting evolute of a lighting device according to FIGS. 3 to 5.
Figure 8:
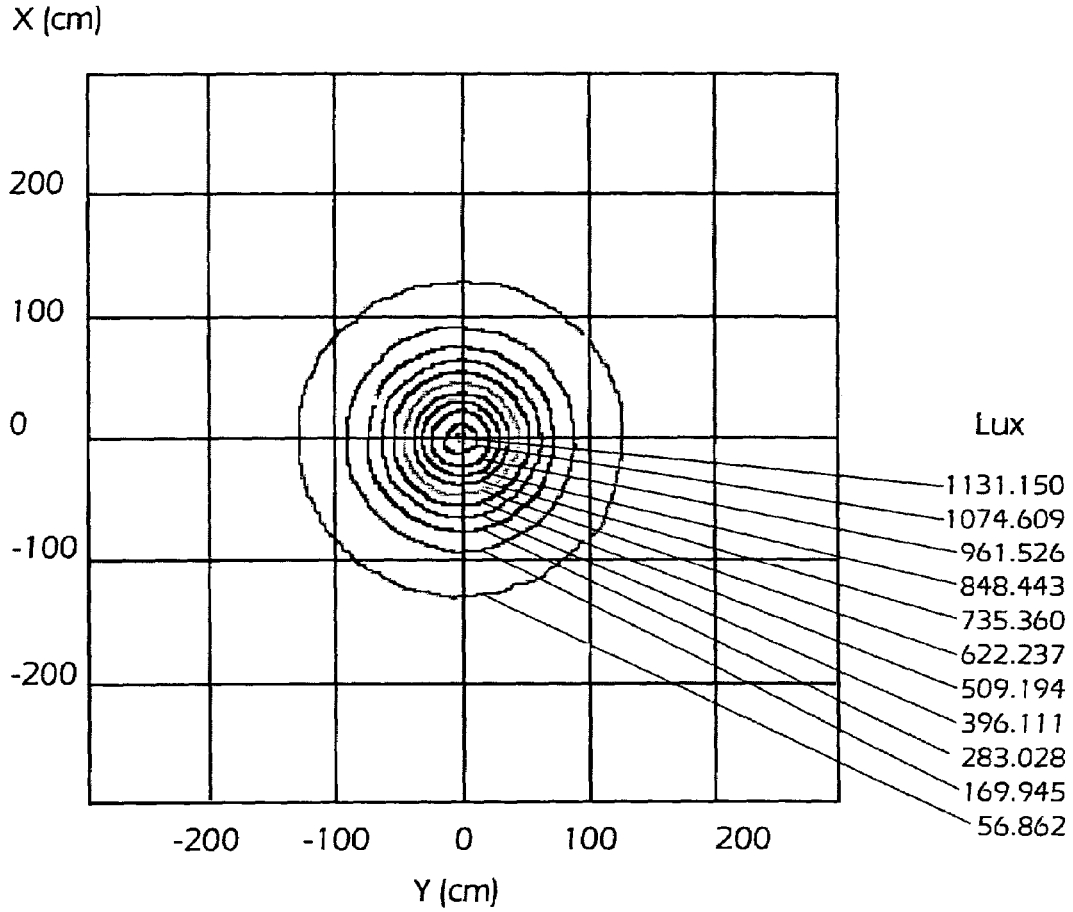
FIG. 8 is a diagram of the illumination under the conditions in FIG. 7, but with a transparent posterior evolute.

With regard to the lighting device according to FIGS. 3 to 5 with an upper evolute coated with reflecting material (reflectance 0.85), FIG. 6 shows the corresponding illumination diagram at a distance of 1.6 m from the opening and FIG. 7 shows the illumination diagram at 0.6 m from the posterior evolute. FIG. 8 shows the illumination diagram at 0.6 m from the posterior evolute when the latter is transparent.

In connection with the lighting device illustrated in FIGS. 3 to 5 with an upper evolute coated with reflecting material (reflectance 0.85), FIG. 9 shows the illumination diagram in the vertical direction, that is the appearance adopted by the reflector in the eyes of an observer looking at it from below when the source is lit.

Now once again making reference to FIG. 1, the principal opening, or the lower mouth 9 for a person observing that figure, may be left completely open, or may be enclosed by a surface which is transparent or diffusing in at least one part, for example that surrounding the normal projected by the source onto that surface in order to prevent direct view of the source when reflector 3 is viewed from below.

Figure 10:
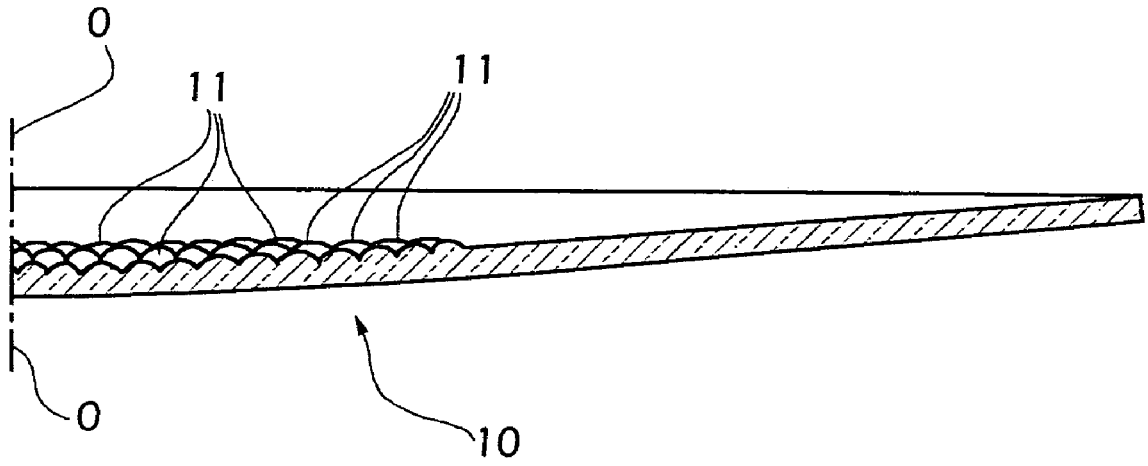
FIG. 10 is a view in partial cross-section which shows a transparent closure element which can be fitted to the opening of a reflector of a lighting device according to the invention.

As an alternative opening 9 of reflector 3 may be enclosed with a transparent diaphragm 10 (shown in cross-section in FIG. 10) whose surface is completely or at least partly covered by micro lenses 11, typically having a diameter of 2 mm or less, capable of creating a dispersed multitude of virtual images of the source in order to increase the uniformity of luminance in the exit plane of the device, reduce local brightness and glare, and likewise mask, at least from some viewing angles, a direct view of source 2 by the viewer.

The peripheral part of enclosing wall 10 may conveniently have an inclination of between 4° and 8°, having a greater thickness in the central part, in order to permit greater control of the luminance distribution at large angles.

The above considerations in respect of closure of the principal opening of reflector 3 also apply, making the necessary changes, to the reflectors of lighting devices according to FIGS. 3 to 5, 13 and 14.

Figure 16:
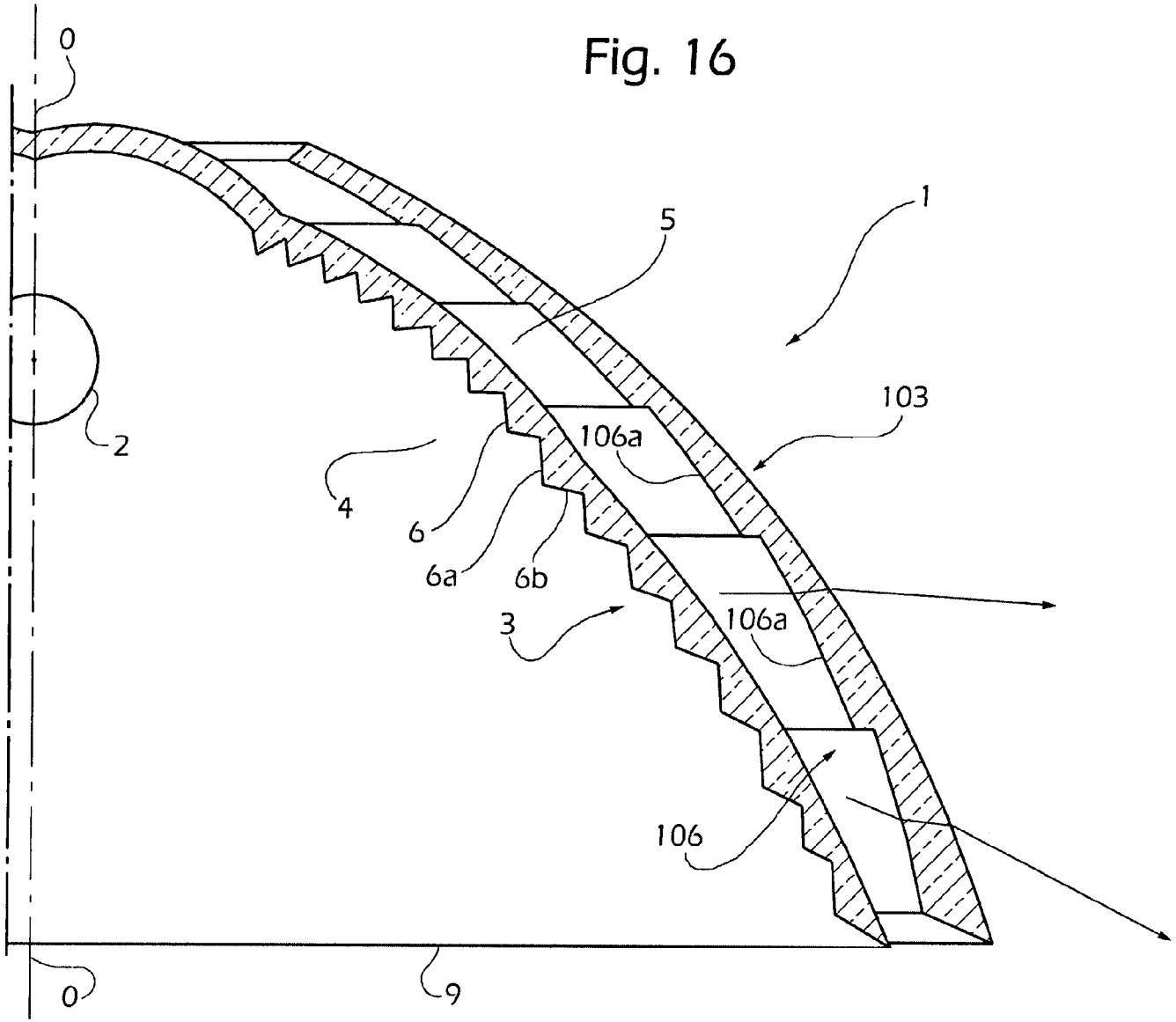
FIG. 16 is a partial view of a possible configuration of a device according to the invention provided with a second optical element outside the reflector.

With reference to FIG. 16, in a lighting device 1 according to the invention it is also possible to provide for the presence of a second optical member 103, outside reflector 3, which may be manufactured from transparent material or coated with reflecting material on its inner surface and designed to perform the dual function of:

1) protecting reflector 3 from the deposition of dust, moisture or other agents which might have an adverse effect on its optical properties;
2) deviating the optical path of the fraction of rays emitted by source 2 either upwards or downwards, which following multiple reflections within reflector 3 escape the outer surface of reflector 3 in an uncontrolled way, increasing luminance at large angles.

In at least one transverse plane passing through source 2 optical element 103 has a profile in cross-section comprising:

1) two curved lines which are substantially parallel to each other;
2) two curved lines with a spacing which increases towards exit mouth 9 in order to contain luminance at large angles, downwardly deviating a fraction of the light rays leaving reflector 3 in an uncontrolled way;
3) two curved lines with a spacing which increases with distance from exit mouth 9 in order to deviate upwards a fraction of the light rays leaving reflector 3 in an uncontrolled way;
4) at least one discontinuous line forming a plurality of adjacent steps 106, each of which has a face 106*a* facing the source suitably inclined in order to reduce luminance at large angles, deviating a fraction of the incident light rays downwards or upwards.

Optical element 103 may be associated with:

1) reflector 3 in the configuration in FIG. 2 obtained by rotation of the reflector profile according to FIG. 1 about the O—O axis; optical element 103 is obtained by rotation of the profile according to FIG. 16 about the same O—O axis;
2) reflector 3 in the configuration in FIGS. 3–5, optical element 103 being obtained by rotation of the profile in FIG. 16 about the same axis of construction in the said Figures and parallel to the O—O axis;
3) reflector 3 in the configuration in FIGS. 13–14, optical element 103 being then obtained by a translational movement of the profile in FIG. 16.

In the lighting device according to FIG. 11, the principal opening of reflector 3 is instead associated with a structure 12 comprising a plurality of a longitudinal walls 13 essentially parallel to and coaxial with the optical axis O—O or reflecting and suitably shaped so that the light emitted by source 2 is reflected downwards at small angles with respect to optical axis O—O. Walls 15 are connected together by a plurality of opaque or reflecting radial walls or septa 15 and suitably shaped so that the light emitted by the source is reflected downwards at small angles with respect to optical axis O—O. Structure 12 is preferably such as to prevent a direct view of source 2 at viewing angles greater than 60° and makes it possible to control luminance, keeping it below 200 cd $m^{-2}$ at viewing angles greater than 60° (device of the "dark light" type).

A similar arrangement can be adopted in the case of the lighting device according to FIGS. 13 and 14: In this case provision may be made for an array of essentially vertical walls which are opaque or reflecting and suitably shaped so that the light emitted by the source is reflected downwards at small angles with respect to the optical axis, aligned together in an direction parallel to the axis of light source 2, possibly intersected by longitudinal walls parallel to the axis of the source; the purpose of this configuration is also to prevent direct viewing of the source at viewing angles greater than 60°.

Figure 12:
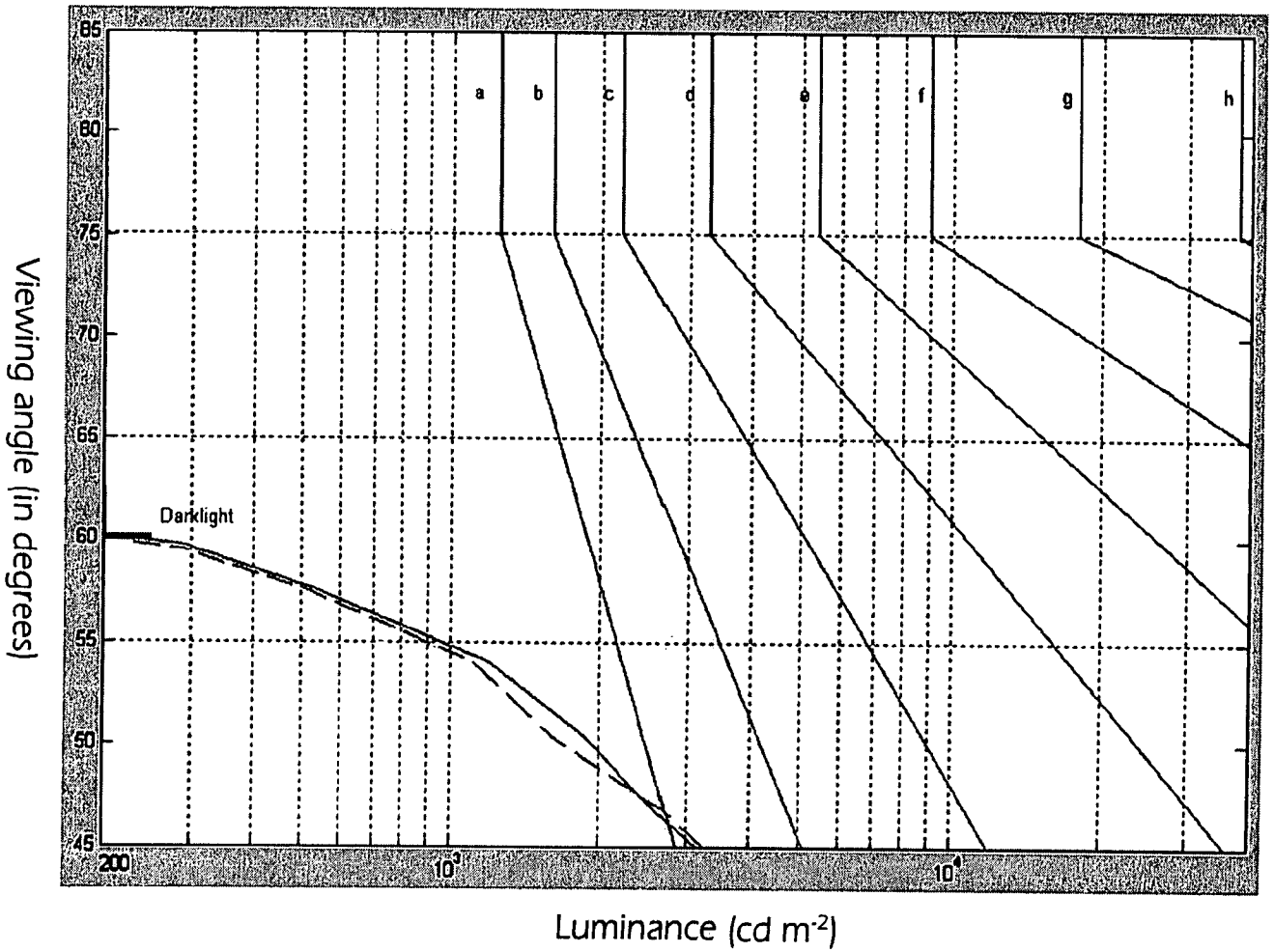
FIG. 12 shows a diagram of the average luminance measured at the opening of a reflector provided with a brightness control structure.

In relation to the lighting device according to FIG. 11, FIG. 12 shows the corresponding average luminance curve measured at the exit opening of reflector 3 in relation to viewing angle, showing that the limit of 200 cd $m^{-2}$ is reached at viewing angles greater than 60°.

Figure 17:
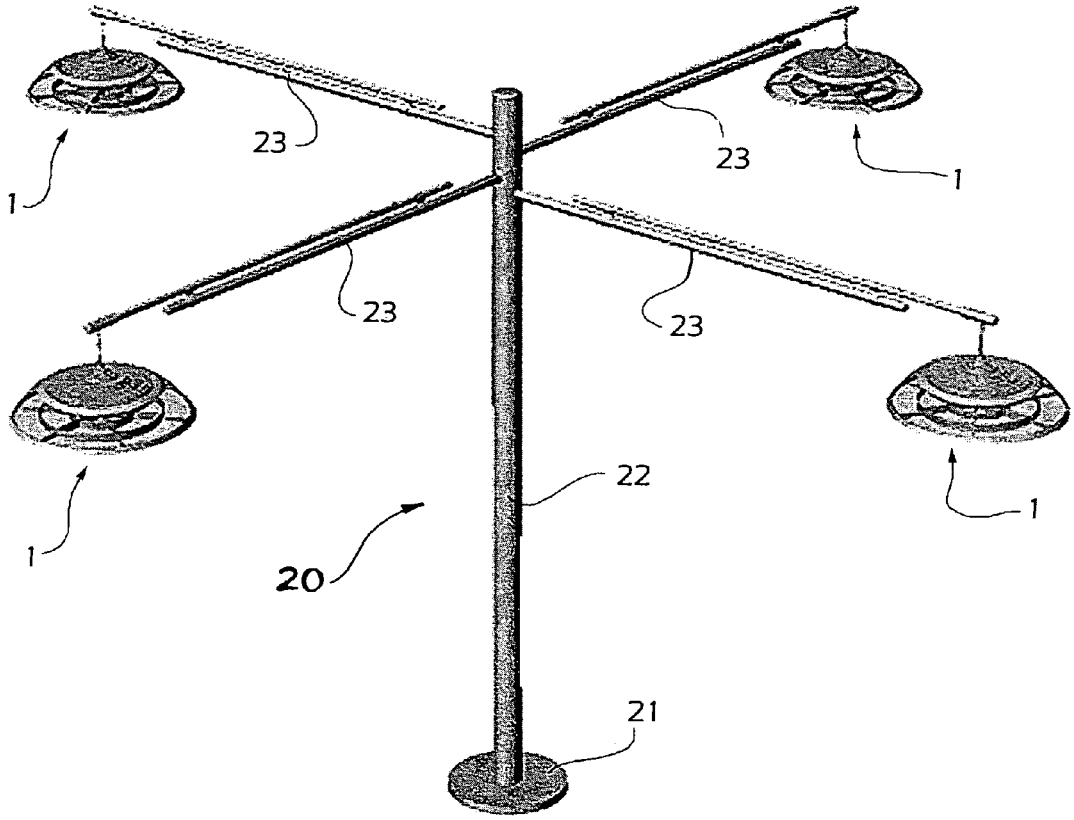
FIG. 17 is a perspective view showing a lighting device comprising a standard and a plurality of lighting devices substantially of the type illustrated in FIG. 10.
Figure 18:
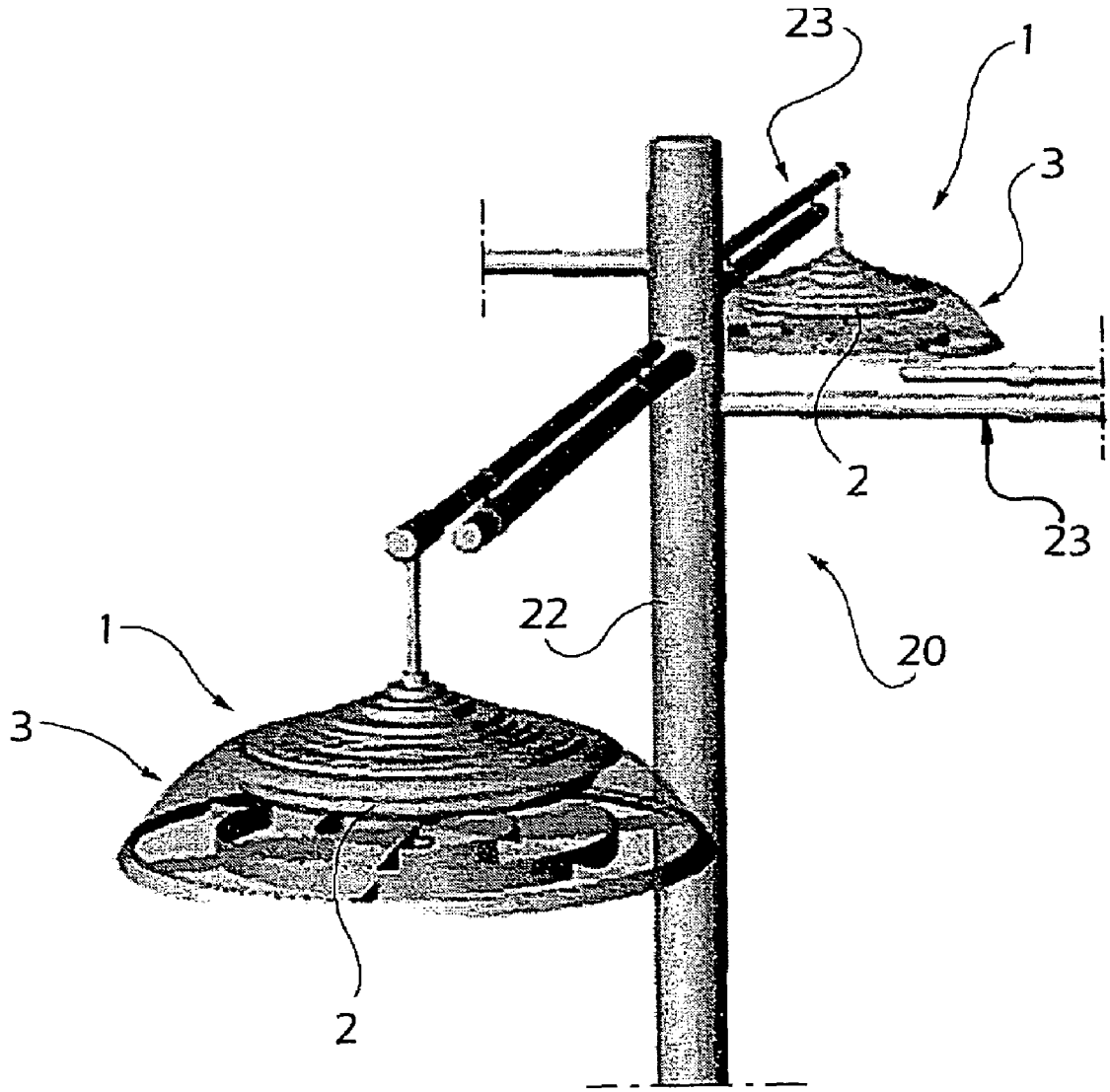
FIG. 18 is a perspective view which shows part of the lighting device in FIG. 17 on an enlarged scale.

The lighting devices according to the invention are suitable for being suspended from the ceiling or from the arms of loadbearing structures such as the standard shown by way of example in FIGS. 17 and 18. In the embodiment illustrated this standard, indicated as a whole by 20, comprises a lower supporting base 21 from which their rises vertically an upright 22, from the top portion of which there extends a plurality of arms 23 at the extremities of which lighting devices 1, for example of the type previously described with reference to FIG. 11, are suspended.

Of course, without altering the principle of the invention, embodiments and construction details may be varied widely in comparison with what has been described and illustrated purely by way of a non-restrictive example without thereby going beyond the scope of the invention as defined in the appended claims.

What is claimed is:

1. Lighting device, comprising:

a light source; and an associated hollow reflector of transparent material having an inner surface and an outer surface, close to and far from the source respectively;

the inner surface of the reflector having in cross-section, in at least one transverse plane passing through the source, a discontinuous profile forming a plurality of adjacent steps, each of which has a first face through which rays originating from the source may pass and a second face essentially parallel to the rays originating from the source;

the outer surface of the reflector having a profile in the transverse plane comprising a plurality of arcs of conic curves having eccentricities, foci and axes which do not necessarily coincide with each other;

the reflector being constructed and arranged in such a way that in the transverse plane most of the rays emitted by the source are refracted through the first faces of the steps on the inner surface and strike the outer surface of the reflector undergoing total internal reflection and, having passed back through the reflector, re-emerge outside the same through the second faces of the steps on the inner surface of the reflector undergoing a second refraction.

2. Lighting device according to claim 1, in which the plurality of arcs of conic curves are contiguous.

3. Lighting device according to claim 1, in which the reflector has a shape essentially in the form of a portion of a rotation ellipsoid and/or paraboloid and/or hyperboloid.

4. Lighting device according to claim 1, in which the reflector has a shape essentially in the form of a plurality of portions of rotation ellipsoids and/or paraboloids and/or hyperboloids.

5. Lighting device according to claim 1, in which the reflector has a shape essentially in the form of a portion of a torus having a substantially elliptical and/or parabolic and/or hyperbolic cross-section, and the source has an annular shape and lies essentially along a focal circumference of the torus having an elliptical and/or parabolic and/or hyperbolic cross-section.

6. Lighting device according to claim 1, in which the reflector has a shape comprising portions of toruses having an approximately elliptical and/or parabolic and/or hyperbolic cross-section, and the source has an annular shape and lies essentially upon the focal circumference common to the toruses having an elliptical and/or parabolic and/or hyperbolic cross-section.

7. Lighting device according to claim 1, in which the reflector has a shape essentially in the form of a portion of a cylinder having a substantially elliptical and/or parabolic and/or hyperbolic cross-section, and the source has a linear shape and lies essentially along a focal straight line of the cylinder having a substantially elliptical and/or parabolic and/or hyperbolic cross-section.

8. Lighting device according to claim 1, in which the reflector has a shape comprising portions of cylinders having a substantially elliptical and/or parabolic and/or hyperbolic cross-section and the source has a linear shape and lies essentially along a common straight line focus for the cylinders having a substantially elliptical and/or parabolic and/or hyperbolic cross-section.

9. Lighting device according to claim 7, in which the reflector at each extremity of the portion of a cylinder having an elliptical and/or parabolic and/or hyperbolic cross-section has a corresponding terminal portion essentially in the form of a portion of a rotation ellipsoid and/or paraboloid and/or hyperboloid, the portion of rotation ellipsoid and/or paraboloid and/or hyperboloid being connected continuously with the cylindrical portion having an elliptical and/or parabolic and/or hyperbolic cross-section at the two extremities.

10. Lighting device according to claim 8, in which the reflector at each extremity of the portions of cylinders having an elliptical and/or parabolic and/or hyperbolic cross-section has a corresponding terminal section essentially in the form of portions of rotation ellipsoids and/or paraboloids and/or hyperboloids, the portions of rotation ellipsoids and/or paraboloids and/or hyperboloids being connected continuously to the said portions of cylinders having an elliptical and/or parabolic and/or hyperbolic cross-section at the extremities.

11. Lighting device according to claim 1, in which the reflector close to the source has an unobstructed bottom opening.

12. Lighting device according to claim 1, in which the reflector close to the source has a transparent bottom connecting wall.

13. Lighting device according to claim 1, in which the reflector close to the source has a bottom closure wall having an evolute profile.

14. Lighting device according to claim 13, in which the closing wall having an evolute profile is coated on the inner or outer surface with an optically reflecting material.

15. Lighting device according to claim 12, in which the transparent connecting wall has an inner surface and an outer surface which are close to and far from the source respectively;

the inner surface having at least in a transverse plane passing through the source a profile comprising one or more arcs and curves through which rays originating from the source may pass;

the outer surface having a cross-section in the transverse plane, a discontinuous profile forming a plurality of adjacent steps, each of which has a first and a second face, each of which is capable of reflecting the rays originating from the source towards the other face through the effect of total internal reflection;

the connecting wall being constructed and arranged in such a way that in the transverse plane, most of the rays emitted by the source are refracted through the inner surface, strike the outer surface undergoing double total internal reflection at the faces of the steps and after passing back through the connecting wall emerge outside the said through the inner source undergoing a second refraction.

16. Lighting device according to claim 1, in which a further optical element is present outside the reflector in order to deviate in predetermined ways the optical path of a fraction of the light radiation which following multiple reflections within the reflector is likely to escape through the outer surface of the reflector.

17. Lighting device according to claim 16, in which the optical element comprises a wall of transparent material.

18. Lighting device according to claim 1, wherein the reflector has an outlet opening for the reflected radiation, this outlet opening being completely open.

19. Lighting device according to claim 1, wherein the reflector has an outlet opening for the reflected light associated with a closing wall which is transparent or at least partly diffuses the light radiation.

20. Lighting device according to claim 19, in which the transparent closing wall has a plurality of micro lenses in at least one part of the surface.

21. Lighting device according to claim 1, wherein the reflector has an outlet opening fox the reflected radiation, associated with a system of fins substantially parallel to the optical axis of the reflector.

22. Lighting device according to claim 21, wherein the luminance at the outlet opening of one exit is less than 200 cd $m_{-2}$ for angles of 60° or more with respect to the optical axis.

* * * * *